US011112062B2

(12) United States Patent
Kreutzer et al.

(10) Patent No.: US 11,112,062 B2
(45) Date of Patent: Sep. 7, 2021

(54) SAFETY SYSTEM FOR A PRESSURE ACCUMULATOR

(71) Applicant: HYDAC TECHNOLOGY GMBH, Sulzbach/Saar (DE)

(72) Inventors: Thomas Kreutzer, Merchweiler (DE); Thomas Goetz, Merchweiler (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 0 days.

(21) Appl. No.: 16/634,599

(22) PCT Filed: Aug. 9, 2018

(86) PCT No.: PCT/EP2018/071644
§ 371 (c)(1),
(2) Date: Jan. 28, 2020

(87) PCT Pub. No.: WO2019/034529
PCT Pub. Date: Feb. 21, 2019

(65) Prior Publication Data

US 2020/0149683 A1 May 14, 2020

(30) Foreign Application Priority Data

Aug. 12, 2017 (DE) ..... 10 2017 007 628.6

(51) Int. Cl.
*F15B 1/08* (2006.01)
*F17C 13/04* (2006.01)
(Continued)

(52) U.S. Cl.
CPC ..... *F17C 13/04* (2013.01); *F15B 1/08* (2013.01); *F15B 20/00* (2013.01); *F15B 21/005* (2013.01);
(Continued)

(58) Field of Classification Search
CPC .. F17C 13/04; F15B 1/08; F15B 20/00; F15B 21/005; F15B 2211/41
See application file for complete search history.

(56) References Cited

U.S. PATENT DOCUMENTS 4,076,176 A 2/1978 Torrence
2015/0184805 A1 7/2015 Lee

FOREIGN PATENT DOCUMENTS

DE 244 387 4/1987
DE 10 2010 008 636 8/2011
(Continued)

OTHER PUBLICATIONS

International Search Report (ISR) dated Dec. 4, 2018 in International (PCT) Application No. PCT/EP2018/071644.

*Primary Examiner* — Abiy Teka
(74) *Attorney, Agent, or Firm* — Wenderoth, Lind & Ponack, L.L.P.

(57) ABSTRACT

A safety system has a valve block (10) to which at least one gas safety valve (12, 14) is connected in a detachable manner. At least one controllable valve (50, 52, 58) is in or at the valve block (10). At least one pressure accumulator (42) holds a gaseous pressure medium and is connected to the valve block (10) in a detachable manner. A gas-conveying connection routed at least partially within the valve block (10) between the connected pressure accumulator (42) and the connected gas safety valves (12, 14) can be opened or blocked by the valve (50, 52, 58).

21 Claims, 7 Drawing Sheets

(51) Int. Cl.
*F15B 20/00* (2006.01)
*F15B 21/00* (2006.01)

(52) U.S. Cl.
CPC . *F15B 2211/41* (2013.01); *F15B 2211/50518* (2013.01); *F15B 2211/8757* (2013.01); *F17C 2205/0329* (2013.01); *F17C 2205/0332* (2013.01); *F17C 2205/0385* (2013.01); *F17C 2221/014* (2013.01)

(56) References Cited

FOREIGN PATENT DOCUMENTS

| | | | | |
|---|---|---|---|---|
| DE | 10 2014 013 098 | | 12/2015 | |
| EP | 2 857 727 | | 4/2015 | |
| FR | 3 024 204 | | 1/2016 | |
| WO | WO-2011101293 | A1 * | 8/2011 | ..... B60L 5/32 |

* cited by examiner

SAFETY SYSTEM FOR A PRESSURE ACCUMULATOR

FIELD OF THE INVENTION

The invention relates to a safety system having a valve block to which at least one gas safety valve is connected in a preferably detachable manner, having at least one controllable valve in or at the valve block and having at least one pressure accumulator holding the gaseous pressure medium. The pressure accumulator is also connected to the valve block in a detachable manner.

BACKGROUND OF THE INVENTION

Such a safety system can be found in different hydraulic supply systems and is known for instance from the product catalog "Speichertechnik" (storage technology) No. D 3.553.4/03.16 by HYDAC INTERNATIONAL. The known solution is used for filling and testing hydro-storage facilities having a back-up version. For this purpose, the known valve block has various fluid ports, in particular for the connection of a filling and testing device, a pressure gauge, downstream nitrogen cylinders, a pressure accumulator in the form of a hydraulic accumulator and at least one gas safety valve. During operation of the valve block, the gas end of the hydraulic accumulator, preferably in the form of a piston accumulator, is permanently connected to the gas safety valve. The liquid end of the hydraulic accumulator, which is separated from the gas end by a separating element, such as a separating piston movable longitudinally in a storage housing, is connected to a hydraulic supply system, for instance in the form of a conventional hydraulic circuit. Further, a shut-off valve is in the valve block, which shut-off valve in its open position opens the fluid path between the possibly connected, downstream nitrogen cylinders and the hydraulic accumulator for a gas-conveying connection to the nitrogen gas and which shut-off valve in its closed position, blocks this fluid path.

When removing the gas safety valve from the valve block, for instance, in the context of maintenance or repair work, then the pressurized working gas has to be completely vented from the safety system every time. The individual connected hydraulic accumulator and/or the individual connected nitrogen cylinders have to be closed, and at least parts of a connected hydraulic system must be depressurized accordingly. Upon subsequent recommissioning of the safety system, including the assigned gas safety valve and correspondingly connected pressure accumulators, the above-mentioned decommissioning steps have to be reversed.

SUMMARY OF THE INVENTION

Based on this prior art, the invention addresses the problem of providing a safety system having improved functionality and conserving resources.

A safety system according to the invention solves this problem.

A particularly high level of safety is achieved because, according to the invention, a gas-conveying connection routed at least partially within the valve block between the connected pressure accumulator and the connected gas safety valve can be opened or blocked by the valve. The individual gas safety valve can be removed from the valve block, if necessary, provided that the assigned valve in or at the valve block is brought into its blocking position and is safely separated from the gas end of the connected gas pressure accumulator. The gas pressure accumulator is composed of a hydraulic accumulator or a gas reservoir, such as a nitrogen cylinder or any other at least partially gas-holding pressure vessel, such as a storage tank or the like.

The safety system according to the invention provides the option of shutting off the gas safety valve connected to the valve block of the safety system via an assigned controllable valve without suffering substantial gas losses at the end of the pressure accumulator system connected to the valve block and without depressurizing any components of the hydraulic system.

The required removal of a gas safety valve from the valve block of the safety system required during repair and/or maintenance work can be performed quickly and inexpensively. Any time-consuming emptying and filling procedures at the gas end of a connected system having the pressure accumulator can be omitted, which conserves resources. This ability is without parallel in the prior art.

Pressure accumulators according to the invention include all containers, such as pressure vessels, hydraulic accumulators, gas cylinders, in particular nitrogen cylinders, and the like, suitable and used for receiving a fluid, in particular a gas. The accumulator used in the safety system according to the invention is not limited to the usual language definitions in individual areas.

In a preferred embodiment of the safety system according to the invention, the pressure accumulator is a pressure vessel, which is or can be filled exclusively with the gaseous pressure medium, such as a nitrogen cylinder or a hydraulic accumulator. The hydraulic accumulator, in particular may be designed as a bellows, membrane, storage or piston, whose separator accommodated in a storage housing separates a gas end from a liquid end. In this way, various types of pressure accumulators, which are only connected to one valve block, can be safely operated and controlled based on only one safety system, which is regularly the case, when at least one hydraulic accumulator is connected as a pressure accumulator to a hydraulic system at one end of the valve block. Additional nitrogen cylinders are connected as storage or downstream cylinders at the same or another end of the valve block, which cylinders can, for an established fluid supply, be used to recharge the hydraulic accumulator at its gas end even in operation or increase its prestress at its gas end in operation.

In a further preferred embodiment of the safety system according to the invention, at least two gas safety valves are connected to the valve block. A safety device ensures that the gas-conveying connection to each connected pressure accumulator is interrupted before a gas safety valve is removed from the valve block. The connection leading to at least one other gas safety valve is maintained such that a permanent gas-conveying connection between this individual pressure accumulator and this other gas safety valve is established during the replacement of the one gas safety valve and its re-commissioning. In this way, the operation of a hydraulic, at least partially gas-conveying plant can be maintained, even if a gas safety valve is removed from the valve block, because the gas safety valve remaining at the valve block for safety reasons fully takes over the addressed safety functions.

The safety system according to the invention, in particular, ensures that during commissioning and continuous operation of a hydraulic supply system, the gas safety valve set to maximum response pressure remains permanently connected to the gas end of the pressure accumulator. The pressure accumulator liquid end remains connected to a hydraulic system or equipment, for instance in the form of a hydraulic accumulator. In particular, for a plurality of gas safety valves used at the valve block, for cleaning and/or maintenance of such a gas safety valve, the gas safety valve can be removed from the valve block, while the other gas safety valve remaining at the valve block takes over the safety function described for the hydraulic supply system and its equipment. Generally, such gas safety valves are composed of pressure relief valves, whose gas outlet end leading to the environment is covered by a mesh grid or a sieve to protect any persons in the vicinity from being affected by the outflow of compressed gas of high pressure in the event of a safety incident.

In a preferred embodiment of the safety system according to the invention, the safety device is based on a mechanical locking system, a mechanical control system, an electrical monitoring system or a chip-controlled actuation system for the relevant controllable valve. Due to the design of the safety device that is based on the requirements of and adapted to the particular application, a secure shut-off of the pressure accumulator, having a low susceptibility to failure and fault, is ensured in operation, for instance, before an assigned gas safety valve is removed. Mechanical systems for locking or controlling the valve have the advantage of high robustness and low maintenance requirements. An electrical or chip-controlled system for monitoring or actuation offers the advantage of a small footprint and the option of remote monitoring when using suitable data transmission.

In a further preferred embodiment of the safety system according to the invention, two, preferably manually operated, ball valves are provided to implement a mechanical locking system, which ball valves are each connected to an assigned gas safety valve in a gas-conveying manner and which ball valves bear control disks ensuring in the mutually locked state that a first ball valve in its open position connects the assigned gas safety valve to the pressure accumulator via a gas-conveying connection and a second ball valve in its blocking position blocks an assigned other connection to the relevant pressure accumulator for the removal of the assigned gas safety valve from the valve block, for instance, for replacement or maintenance purposes.

The control disks are an integral part of a mechanical lock of the actuating elements of the ball valves and preferably are arranged at an outer end of the valve block. Once a ball valve is blocked to remove the assigned gas safety valve, the assigned control disk is interlocked with at least one control disk of a further gas safety valve that the further gas safety valve is blocked in the open, safe operating position and held securely. Thus, when dismounting and removing one gas safety valve, at least one further functional gas safety valve is connected to the valve block in its open position, which then performs solely the safety function.

In a further preferred embodiment of the invention, one of the control disks can, starting from a common opening direction, be actuated in the direction of a closed position of the ball valve by two hand levers of the ball valves. The outer peripheral end of that one control disk has a cutout, which interacts with a correspondingly shaped cutout at the outer periphery of the other control disk such that a rotational movement of the respective ball valve is enabled or blocked by the assigned hand lever. Particularly preferably, the respective cutout has an arcuate contour with a curvature comparable to the outer circumference of the control disk. The other control disk engages with a cutout shaped in that way such that the assigned hand lever is blocked in the selected position, and an unintentional or deliberate change of this position is not possible.

The gas safety valves have a basic cylindrical shape and are arranged at an underside of the valve block. The hand levers for actuating the assigned ball valves are preferably arranged at an end of the valve block accessible to an operator. As a rule a vertical direction indicates the open position and a horizontal direction indicates the closed position of the assigned ball valve. Particularly preferably, the cutouts in adjacent hand levers are arranged such that in the open position of the two hand levers, the cutouts are arranged next to each other and opposite from each other such that upon movement of one hand lever into the closed position, the assigned control disk is moved into the cutout at the other control disk of the other hand lever, thereby blocking its movement in the closed position as well.

Preferably, two or more gas safety valves are arranged next to each other, at the valve block, forming a row. Accordingly, two or more hand levers having assigned control disks are arranged next to each other, at the side of the valve block, forming a row.

It is also advantageous that the control disk interacts with a stop limit at the valve block, such that the hand lever can be pivoted from an opening direction parallel to the longitudinal direction of the relevant gas safety valve by 90° to a blocking position transverse to this longitudinal orientation and vice versa. This interaction results in the advantage of error-free operation when pivoting the relevant hand lever in one of its positions.

In a further preferred embodiment of the safety system according to the invention, a 3-way ball valve is used as a controllable valve to implement a mechanical control system. This ball valve in its one control position connects a gas safety valve via a connection to the pressure accumulator in a gas-conveying manner and decouples another gas safety valve from the pressure accumulator by blocking an assigned further connection. In a further control position, the other gas safety valve is connected to the pressure accumulator via the other connection in a gas-conveying manner, and the one gas safety valve is decoupled by blocking the one connection. By using only one 3-way ball valve, two separate ball valves for the two gas safety valves can be dispensed with. Regardless of the control position of the 3-way ball valve, one gas safety valve is then connected to the pressure accumulator, and one gas safety valve is disconnected therefrom, i.e. at least one gas safety valve always takes over the safety function of the pressure accumulator.

In a further preferred embodiment of the safety system according to the invention, the open and closed positions of the controllable valve are monitored by sensors for the implementation of an electric monitoring system. A higher-level control only permits the hydraulic supply system to operate, if the sensor system detects that the relevant gas-conveying connection between the gas safety valve and pressure accumulator via the controllable valve is actually open and communicates this fact to the controller. This arrangement results in the advantage that an opening or locking of the gas-conveying connection can be "automatically" detected. By an additional optical display, for instance attached to an outside of the valve block, an operator can be notified of the enabling for the removal of the gas safety valve when the other gas safety valve performs the safety function.

In a further preferred embodiment of the safety system according to the invention, a control chip is provided for the implementation of a chip-controlled actuation system. This chip-controlled actuation system permits the operation of the control system of the hydraulic supply system if deployed there, but stops the supply system if it is removed. Upon its deployment at the controllable valve, it decouples the relevant assignable gas safety valve from the pressure accumulator at the gas end by blocking the assigned connection. Conversely, an operation of the hydraulic supply system is only possible when the control chip returns the gas safety valve back to its open position after removal, and this chip re-deployed at the controller permits the resumption of the operation of the connected hydraulic system.

It is also advantageous that the valve block has at least one further supply port, to which at least one further pressure accumulator, preferably a gas pressure accumulator, can be connected. In its open position, the further pressure accumulator is connected to the relevant pressure accumulator, preferably to the gas end of a hydraulic accumulator, in a gas-conveying manner via a check valve arranged within the valve block. In particular, gas can then be taken from the gas supply of the storage cylinder via the further supply port and directed to the gas end of the hydraulic accumulator in order to increase the working capacity of this hydraulic accumulator.

It is also advantageous that the valve block has at least one further port, to which a filling and testing device can be connected. This filling and testing device is connected directly to the pressure accumulator via a filling and test port in the valve block in a gas-conveying manner, preferably is connected to the gas end of a hydraulic accumulator in the form of a piston accumulator. This filling and test port is connected to a further connection between the further pressure accumulator and the pressure accumulator via a check valve, which opens in the direction of the respective controllable valves. Characteristics of the gas, such as temperature and pressure of the gas volume, can be monitored and recorded by the filling and testing device.

If a hydraulic supply system is connected to the above-mentioned hydraulic accumulator in a conventional manner at its liquid end, the safety system according to the invention ensures that in case of malfunction, for instance caused by a fire, no unintentional pressure increases can occur at the gas end of hydraulic accumulator. No unintentional pressure increases occur because the open valve device or the ball valve in the open position ensures that gas can be directly vented to the outside if the pressure at the hydraulic accumulator end exceeds the maximum pressure set at the relevant gas safety valve. In this way, excessive pressure at the liquid end of the hydraulic accumulator and at the end of the supply system, which could result in the bursting of system parts, is immediately vented. The operators at the system components of the supply system are then not exposed to hazards. The safety system further ensures that manual maloperation, which could result in an unwanted shutdown of the function of the gas safety valve, is impossible.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure and that are schematic and not to scale.

DETAILED DESCRIPTION OF THE INVENTION

Figure 1B:
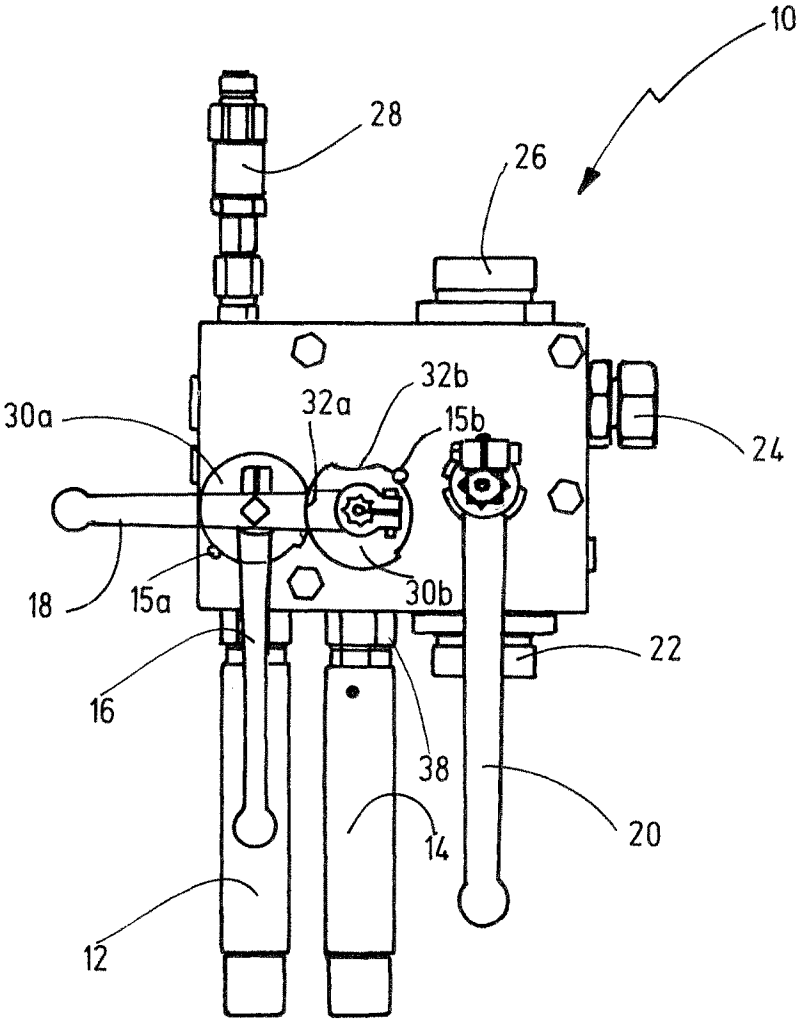
FIGS. 1*a* to 1*c* are side views of a valve block of a safety system having different operating positions of hand levers assigned to individual gas safety valves according to an exemplary embodiment of the invention.
Figure 1A:
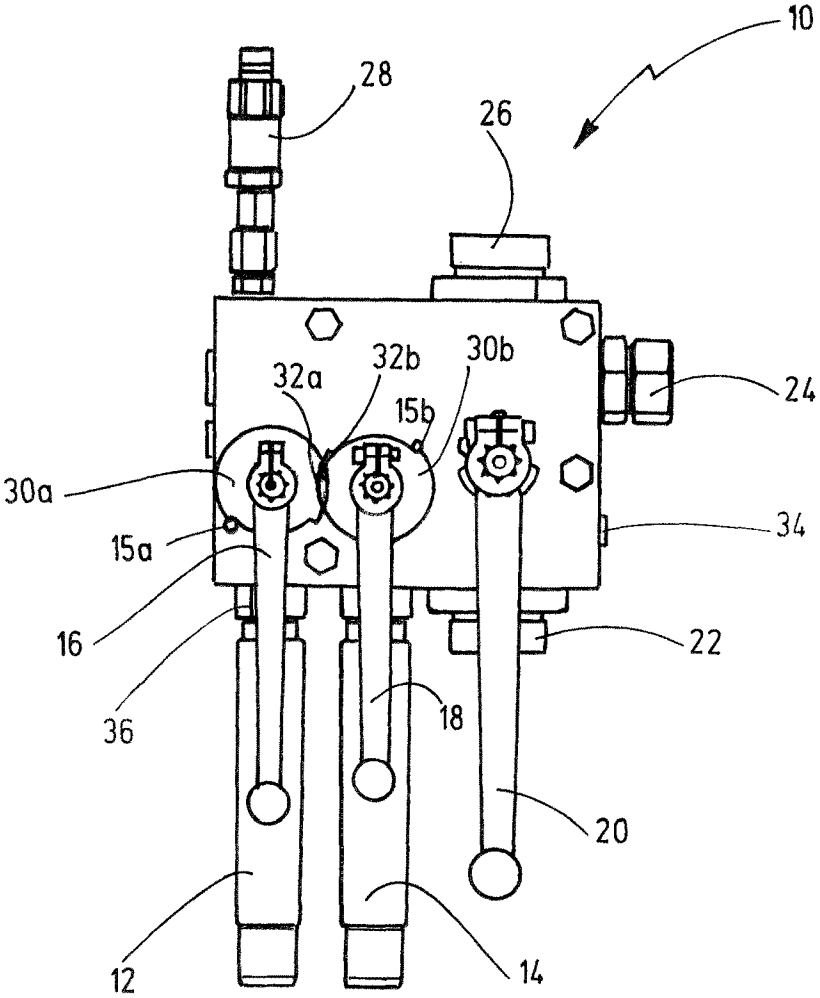
Figure 1C:
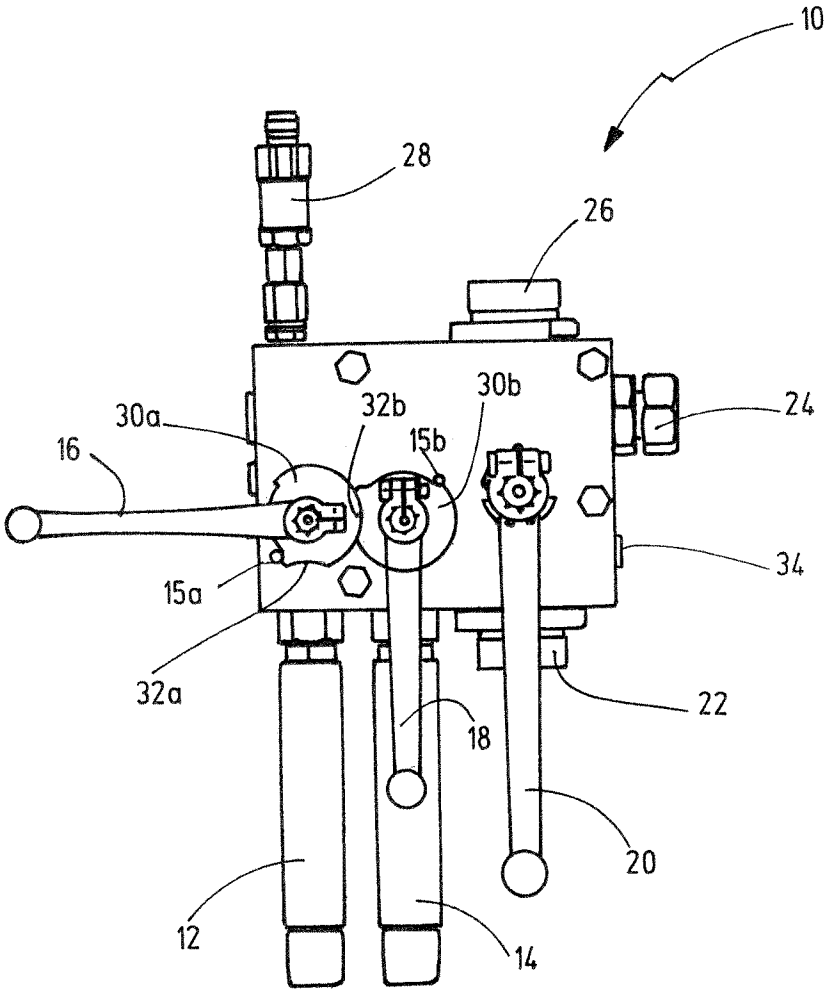

FIGS. 1*a* to 1*c* respectively show a side view of a valve block 10. At the valve block underside a first gas safety valve 12 and a second gas safety valve 14 are arranged. One ball of each ball control valve 50, 52 (see FIG. 3*a, b*) present in the housing of the valve block 10 is assigned to the respective gas safety valve 12, 14. The balls of the ball valves 50, 52 can be alternatively switched back and forth between an open control position and a blocked control position using a first hand lever 16 and a second hand lever 18, respectively. In the control position of the two hand levers 16, 18 shown in FIG. 1*a*, these hand levers are each oriented in the vertical direction, parallel to the cylindrical gas safety valves 12, 14, and thus, are shown in their open control positions. In the closed control position, the assigned hand lever 16 or 18 is aligned or positioned horizontally, as FIG. 1*b* shows for the second hand lever 18 and FIG. 1*c* for the first hand lever 16. While the hand lever 16 has a straight shape, the other hand lever 18 has a crank to swivel it over the hand lever 16 if necessary (see FIG. 2). In the closed control position or closed position, the connection to the gas end 45 of a pressure accumulator 42 (see FIGS. 3*a* and 3*b*), not shown in FIGS. 1*a* to 1*c*, is disconnected by the assigned ball valve 50 or 52, and the removal of the assigned gas safety valve 12 or 14 becomes possible in a safe manner, which will be explained in more detail below.

A third hand lever 20 is arranged at the outside of the valve block 10 spaced apart from the hand levers 16, 18 arranged next to each other. The third hand lever 20 can be used to actuate a ball of a further or third ball valve 54 (see FIGS. 3*a, b*) assigned to a supply port 22. The supply port 22 is arranged in the direction of the FIGS. 1*a, b, c* and 2 at the bottom of the cubical valve block 10. In an end surface of the valve block 10 shown at the right in FIGS. 1*a* to 1*c*, a filling and test port 24 is formed for a gas-end filling and testing device, not shown further. At the top of the valve block 10, there is a pressure port 26 for a connection of the pressure accumulator 42. Further, a measuring device 28 in the form of an electrical pressure transducer is provided at the upper end of the valve block 10. A pressure gauge connection or port 34 for a pressure gauge 44 (see FIGS. 3*a* to 6) is formed at the end surface of the valve block 10 shown at the right in FIGS. 1*a* to 1*c*. The first and second hand levers 16, 18 are each connected to circular control disks 30*a*, 30*b*, which are each arranged coaxially to the axis of rotation of the assigned hand levers 16, 18 at the front face of the valve block 10. The third hand lever 20 has a conventional disk 30*c* (FIG. 2) for limiting rotation.

Each annular control disk 30*a*, 30*b* for the hand levers 16, 18 has a segmented, concave-shaped cutout 32*a*, 32*b* having an arcuate contour. The two cutouts 32*a*, 32*b* are arranged opposite one another in the opened control positions of the two hand levers 16, 18 shown in FIG. 1*a*. The configuration and arrangement of the cutouts 32*a*, 32*b* is selected such that upon movement of the second hand lever 18 clockwise into the closed control position, comparable to the illustration of FIG. 1*b*, the convex outer contour of the second control disk 30*b* at the outer peripheral end is inevitably moved into the first concave recess 32*a* of the first control disk 30*a* of the first hand lever 16. As a result, in the open, vertical control position shown, the first hand lever 16 is mechanically locked by the control disks 30*a*, 30*b*. Similarly, the first control disk 30*a* having a convex or arcuate outer circumference is moved, as shown in FIG. 1*c*, clockwise to the closed control position into the second, concave cutout 32*b* at the second control disk 30*b* when the first hand lever 16 is moved and accordingly the second hand lever 18 is securely locked in the open, vertical control position shown in FIG. 1*c*.

Figure 2:
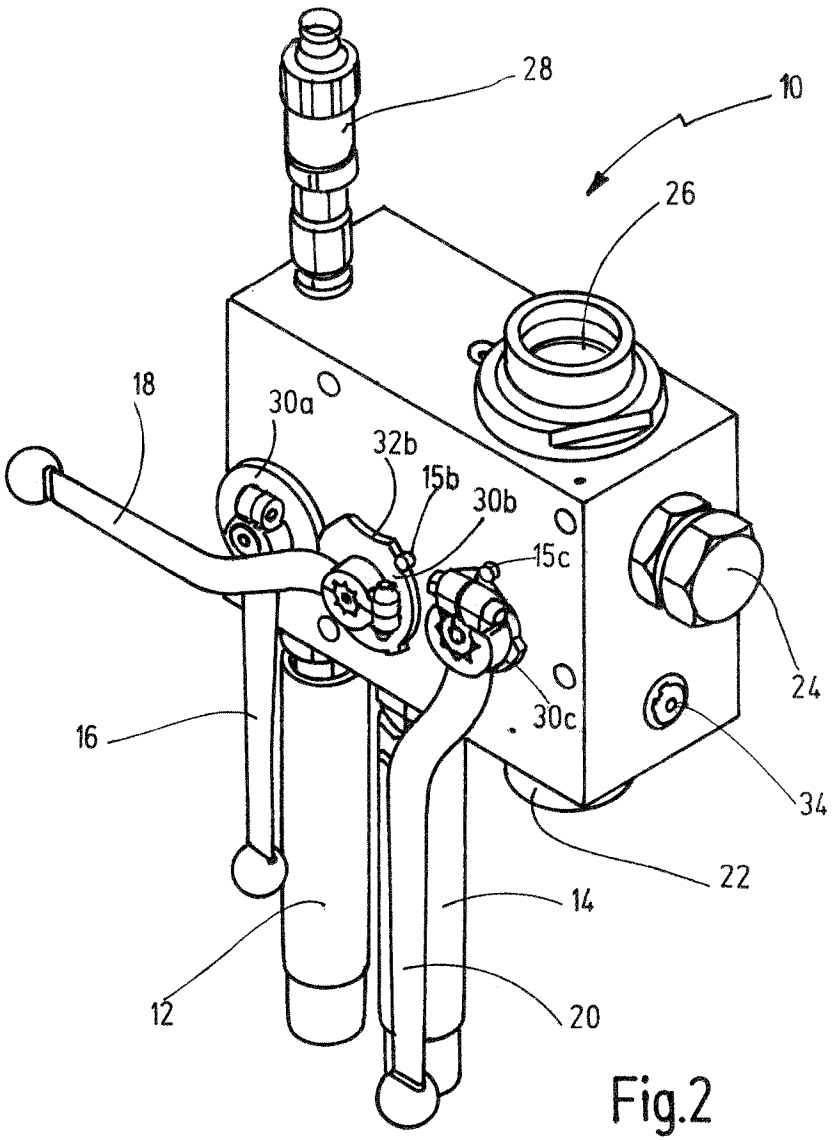
FIG. 2 is a perspective view of the valve block of FIG. 1*b;*

Further two pin-like projecting stop limits, 15*a*, 15*b* are provided at the valve block 10, each defining the rotational movement of the respective assigned hand levers 16, 18 by 90° in the open and the closed control positions and interacting with stop lugs arranged adjacent to the cutouts 32*a*, 32*b* of the respective control disks 30*a*, 30*b*. The pertinent stop limit is common in ball valves, i.e. they will not be discussed further in this context. In particular, individual details have been omitted in the figures for purposes of clarity. FIG. 2 also shows a limit stop 15*c* for a lug formed at the control disk 30*c*, which limits the corresponding rotational movement of the third hand lever 20.

Figure 3A:
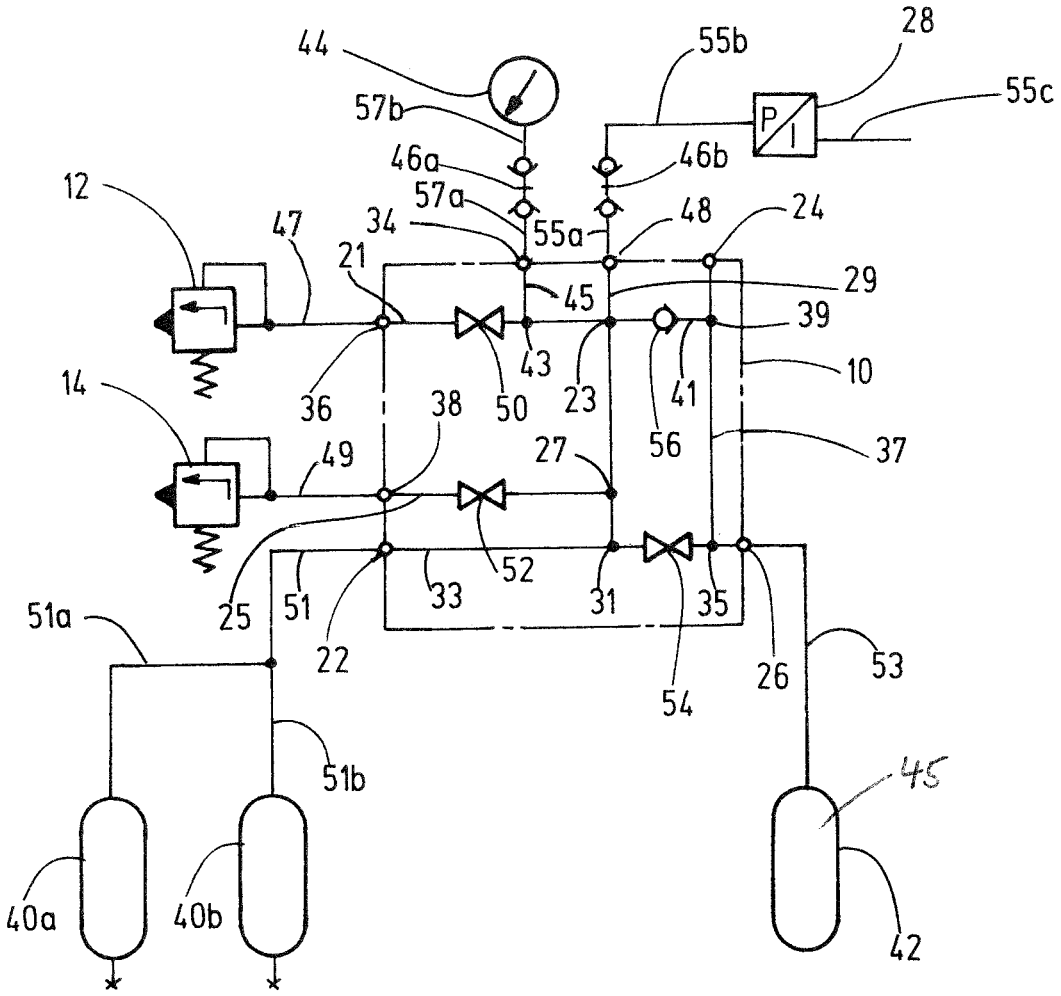
FIGS. 3*a* and 3*b* are a circuit diagrams of a first exemplary embodiment of the safety system according to the invention.

FIG. 3*a* shows a hydraulic circuit diagram of a first exemplary embodiment of the valve block 10 having a first valve port 36 (see FIG. 1*a*) for the first gas safety valve 12 and a second valve port 38 (see FIG. 1*b*) for the second gas safety valve 14. At the supply port 22, two further pressure accumulators 40*a*, 40*b*, designed as gas accumulators in the form of conventional nitrogen recharging cylinders, are connected to the valve block 10, by way of example. Further, a pressure accumulator 42, formed as a pressure vessel exclusively filled with a gaseous pressure medium in the form of a nitrogen cylinder, is connected to the pressure port 26. The pressure gauge 44 is connected to the pressure gauge port 34. The measuring device 28 is connected to a measuring port 48. The pressure gauge 44 and the measuring device 28 of conventional design are connected to the assigned ports or terminals 34 and 48 of the valve block 10 in a fluid and pressure conveying manner via quick-release couplings 46*a*, 46*b*. The solution according to FIG. 3*a* can be used to, among other things, recharge the pressure accumulator 42 with nitrogen from the recharging cylinders 40*a*, 40*b*. The filled reservoir 42 can then be taken filled from the valve block 10 and a new reservoir 42 can be filled again. In that regard, a supply network (not shown) could also replace the individual storage cylinders 40*a*, 40*b*, which supply network can then be used to fill the reservoir 42. Instead of a pressure accumulator 42 in the form of a gas storage cylinder as shown by way of example, a plurality of such gas-conveying storage systems can also be connected to the connection 26 of the valve block 10 (not shown).

In the valve block 10, a plurality of interconnected fluid connections are formed between the first valve port 36, the second valve port 38, the supply port 22, the pressure port 26, the filling and testing port 24, the measuring port 48 and the pressure gauge port 34. Typically, the connections are introduced as drilled holes in the valve block 10 made of a metal material. From the first valve port 36, a first connection section 21 leads to a first intersection point 23. From the second valve port 38 a second connection section 25 leads to a second intersection point 27. The first intersection point 23 and the second intersection point 27 are arranged in a third connection section 29, which extends in the interior of the valve block 10 from the measurement connection 48 to a third intersection point 31.

A fourth connection section 33 extends from the supply port 22 to the pressure port 26. The third intersection point 31 and a fourth intersection point 35 are arranged in the fourth connection section 33. The fourth intersection point 35 is the end of a filling and test connection 37 beginning at the filling and test port 24. A fifth intersection point 39, which represents the end of a fifth connection section 41 beginning at the first intersection point 23, is arranged in the filling and test connection 37. A sixth intersection point 43 is arranged between the first valve port 36 and the first intersection point 22 in the first connection section 21, which sixth intersection point constitutes the end of a sixth connection section 45 beginning at the pressure gauge connection 34.

Further, there is a first line section 47 between the first gas safety valve 12 and the first valve port 36, a second line section 49 between the second gas safety valve 14 and the second valve port 38, third line sections 51, 51*a*, 51*b* between the further pressure accumulators 40*a*, 40*b* and the supply port 22, a fourth line section 53 between the pressure accumulator or gas storage cylinder 42 and the pressure port 26, fifth line sections 55*a*, 55*b*, 55*c* between the measuring device 28 and the measuring port 48 and continuing from the measuring device 28, and sixth line sections 57*a*, 57*b* between the pressure gauge 44 and the pressure gauge port 34.

In the connections leading from the gas safety valves 12, 14 to the pressure accumulator 42, the first ball valve 50 is arranged in the first connection section 21, and the second ball valve 52 is arranged in the second connection section 25. The third ball valve 54 is arranged between the third intersection point 31 and fourth intersection point 35 in the fourth connection section 33 leading to the pressure accumulator 42 and parallel thereto a check valve 56 is installed in the fifth connecting section 41 between the first intersection point 23 and fifth intersection points 39. The check valve opens in the direction of the first intersection point 23. The individual ball valves 50, 52, 54 are actuated individually by hand using the assigned hand levers 16, 18, 20. The filling and test connection 37 leads directly from the fourth intersection point 35 adjacent to the pressure port 26 to the filling and test port 24.

Figure 3B:
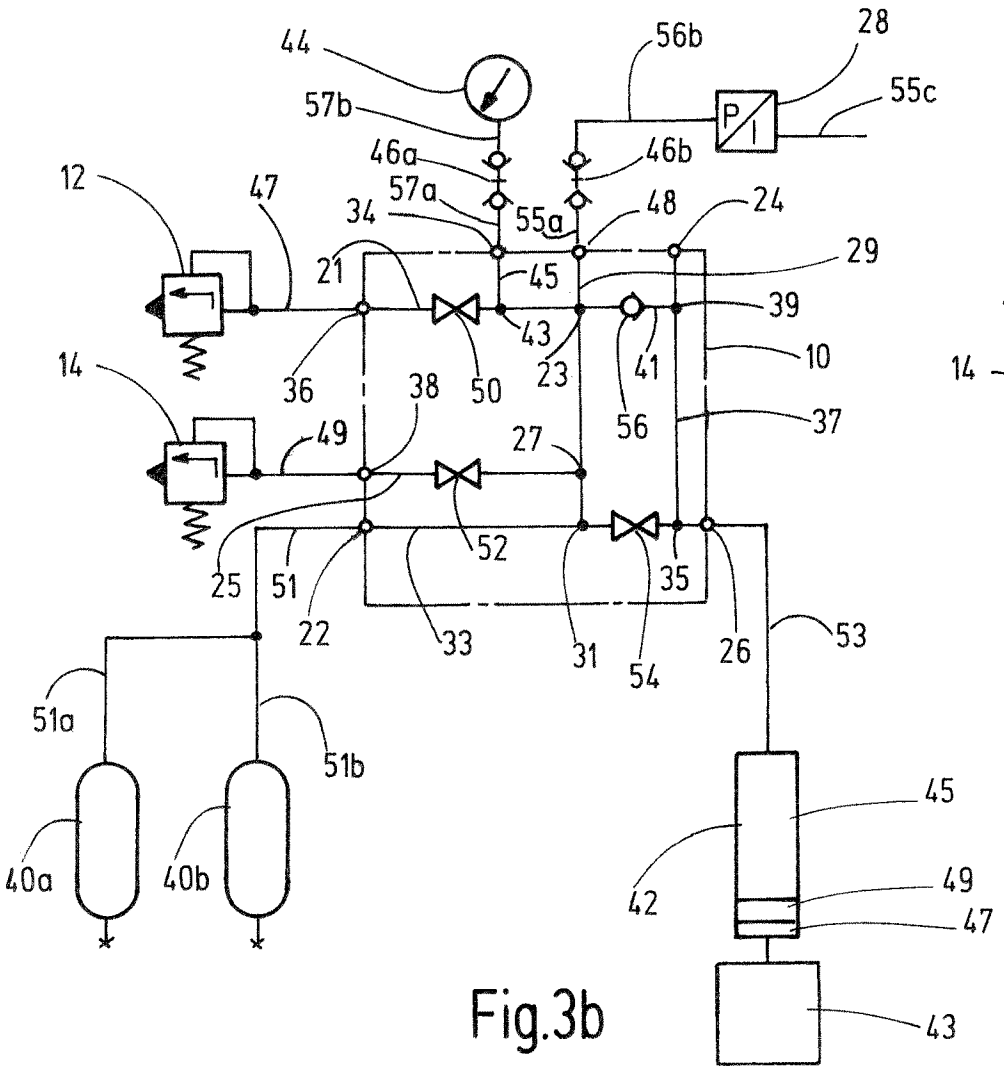

FIG. 3*b* is substantially identical to FIG. 3*a* and differs from the solution shown therein in that instead of a gas storage cylinder 42 designed as a pressure vessel, a pressure accumulator 42 designed as a hydraulic accumulator in the form of a piston accumulator is connected to the pressure port 26 of the valve block 10. In the illustration of FIG. 3*b*, a hydraulic supply system 43 is connected to the hydraulic or liquid end 47 of the pressure accumulator 42 designed as a piston accumulator. The hydraulic supply system generally includes a hydraulic circuit, such as a motor-pump unit, a storage tank, hydraulic loads, control and monitoring devices, etc. (not shown).

As soon as the pressure at the gas end 45 of the pressure accumulator 42 increases due to an impermissible pressure increase, for instance caused by a technical fault in the hydraulic supply system 43, such as a fire, beyond a maximum pressure at the gas end 45 of the pressure accumulator 42, which maximum pressure is preset by the set pressure of the gas safety valves 12, 14, that increased pressure causes their triggering. Gas can then flow from the gas end 45 of the pressure accumulator 42 when the valves in the form of ball valves 50, 52 are open through the gas safety valves 12, 14, until their set pressure of, for instance, 330 bar again is reached or if the pressure has fallen below that value. This safety function is also implemented when the gas ends of the further pressure accumulators 40*a*, 40*b* are separated from the gas end 45 of the pressure accumulator 42 by closing the further third ball valve 54. In this case, the pressure compensation uses the check valve 56, which opens in the direction of the two gas safety valves 12, 14 and insofar opens the assigned connections in the valve block 10, which regularly vent working gas in the form of nitrogen gas, for the purpose of pressure reduction. For the sake of completeness, the piston 49 of the pressure accumulator 42 designed as a piston accumulator separates the gas end 45 from the liquid end 47 leading to the supply system 43. In the exemplary embodiment of the safety system shown in FIGS. 3*a* and 3*b*, the separately operable and switchable ball valves 50, 52 ensure that one of the gas safety valves 12 or 14 is always connected to the pressure accumulator 42 in a gas-conveying manner via the assigned connection, which results in the desired increase in safety as explained above.

Figure 4:
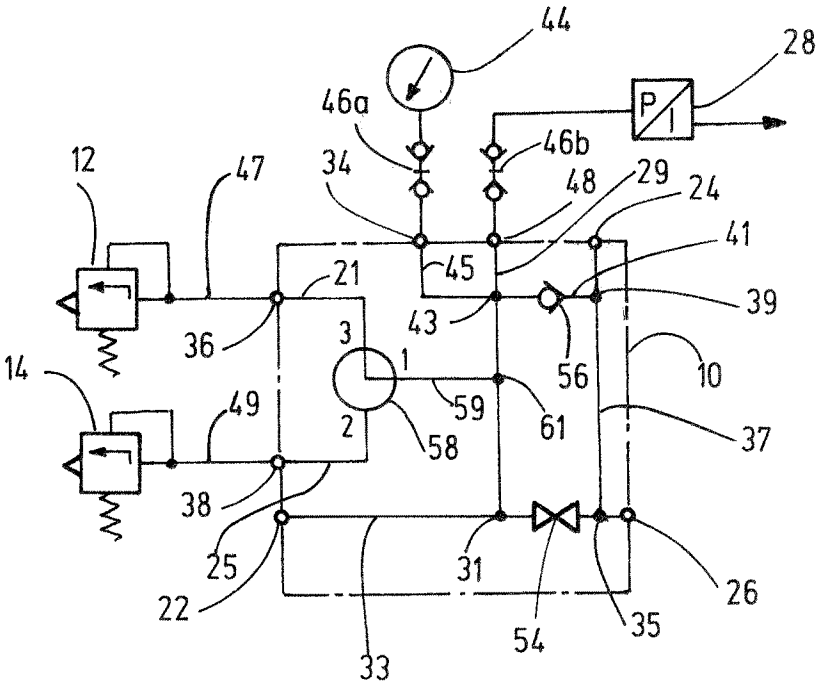
FIG. 4 is a circuit diagram of a second exemplary embodiment of the safety system according to the invention.

The circuit diagram shown in FIG. 4 for a second exemplary embodiment of the safety system differs from the first exemplary embodiment shown in FIGS. 3*a* and 3*b* in that instead of the two ball valves 50, 52, only one 3-way ball valve 58 is arranged in the connections from the gas safety valves 12, 14 to the relevant pressure accumulator 42. Due to the arrangement of the 3-way ball valve 58, the interconnection of the connections in the valve block 10 is modified such that the first connection section 21 and the second connection section 25 each end at the ball valve 58 and such that a common connection section 59 leads from there to a common intersection point 61 in the third connection section 29. The pressure gauge 44 is also connected to the third connection section 29 via the sixth connection section 45. The interconnection of the fourth connection section 33, the fifth connection section 41 and the filling and test port 37 are unchanged. The pressure accumulators 40*a*, 40*b*, 42 are no longer shown in FIG. 4 for the sake of simplicity. Also, the cylinders 40*a*, 40*b* do not necessarily have to be connected to the terminal 22, which has to be closed if not in occupied. The safety functions based on the two gas safety valves 12, 14 and the assigned ball valves 50, 52 is also reduced if only one corresponding pressure accumulator 42 is connected to the port 26 of the valve block 10. Regardless of the rotational position of the ball of the ball valve 58, however, in the 3-way ball valve solution one gas safety valve 12 or 14 is in any case is connected to the pressure accumulator 42 in a gas-conveying manner. Dangerous operating errors are impossible just like in the previously described solutions.

Figure 5:
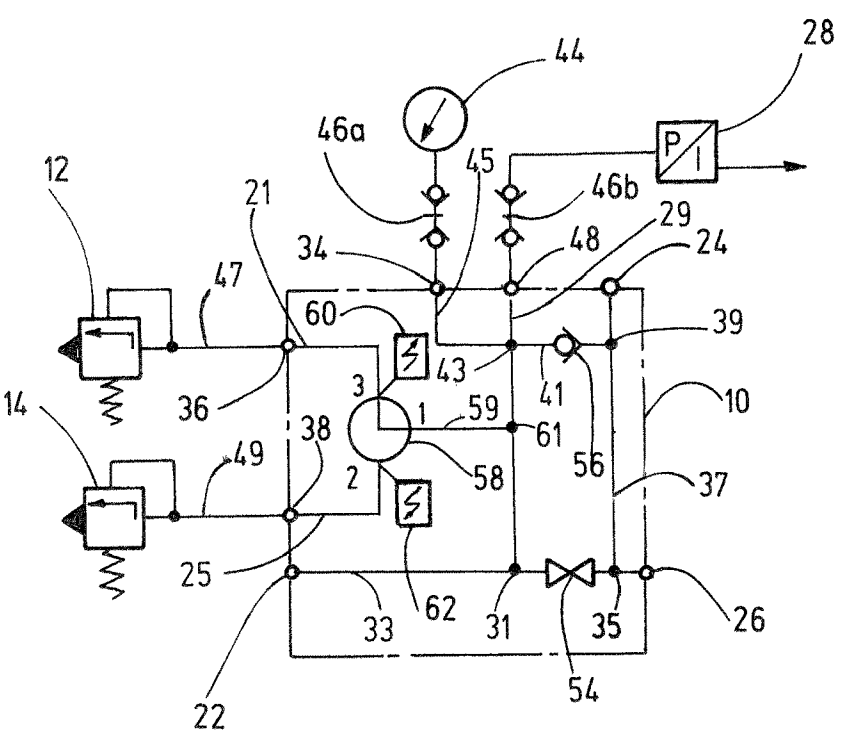
FIG. 5 is a circuit diagram of a third exemplary embodiment of the safety system according to the invention.

In the diagram shown in FIG. 5, in the manner of a hydraulic circuit diagram for a third exemplary embodiment of the safety system, a first monitoring device 60 is provided in the first connection section 21 for the electrical or electronic monitoring of a connection from the first gas safety valve 12 to the pressure accumulator 42. A second comparable monitoring device 62 is provided in the second connection section 25 for monitoring the other connection from the second gas safety valve 14 to the pressure accumulator 42 at the ports 3, 2 of the 3-way ball valve 58. Otherwise, the illustration of FIG. 5 essentially corresponds to the illustration according to FIG. 4.

Figure 6:
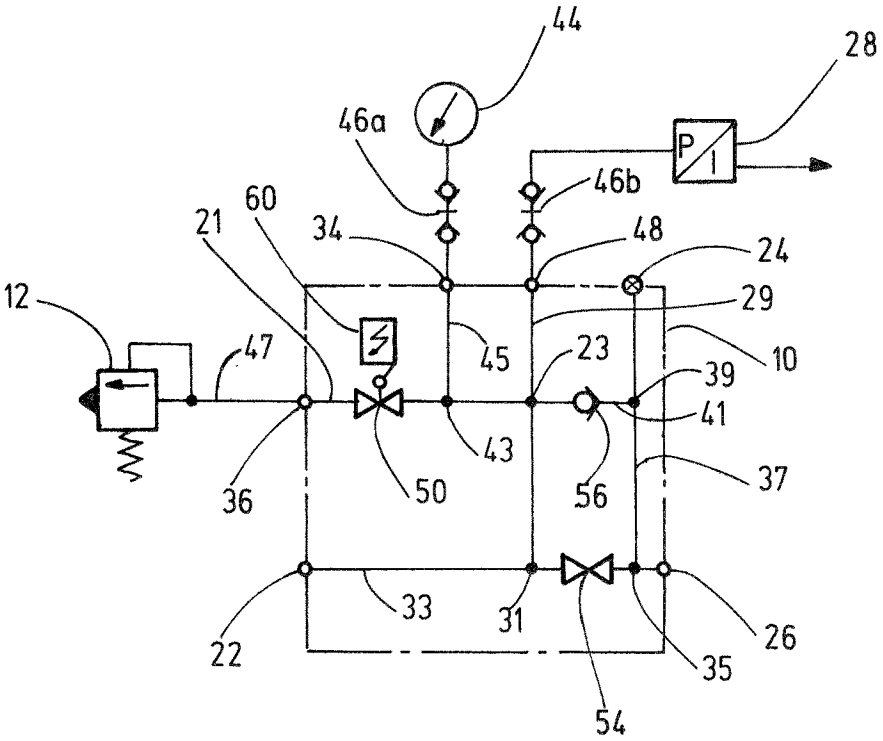
FIG. 6 is a circuit diagram of a fourth exemplary embodiment of the safety system according to the invention.

In the circuit diagram shown in FIG. 6 for a fourth exemplary embodiment of the safety system only one gas safety valve 12 and only one monitoring device 60 are provided, as shown above, in the first connection section 21 for monitoring the one connection from the gas safety valve 12 to the pressure accumulator 42 at the assigned ball valve 50. This monitoring device 60 can optionally electrically or electronically monitor the opening and/or closed position of the ball valve 50. The illustration of FIG. 6 differs from the first exemplary embodiment shown in FIGS. 3*a* and 3*b* in particular in that the second gas safety valve 14, the second line section 49, the second valve port 38, the second connection section 25 together with the second intersection point 27 and the second ball valve 52 can be dispensed with.

In the embodiments of the safety system shown in FIGS. 3*a*, 3*b* and 4, a redundant mechanical locking or valve control system is implemented. In the mechanical locking system according to FIGS. 3*a* and 3*b*, the two assigned 2-way ball valves 50, 52 can be mutually locked in the direction of their respective horizontal closed positions using the control disks 30*a*, 30*b*, such that only one ball valve 50 or 52 can enter its blocking position, which disables the gas-conveying safety function for only one of the two connected gas safety valves 12 or 14. In the valve control system according to FIG. 4, an operator guidance is achieved in the sense that, regardless of the operator's intention, viewed from the valve position of the valve 58, one gas safety valve 12, 14 is always kept in its safety function in any case.

In the exemplary embodiment shown in FIGS. 5 and 6, an electrical or electronic monitoring system is implemented based on at least one monitoring device 60, 62 at the 3-way ball valve 58 or at a ball valve 50. Combinations of such a monitoring system according to FIGS. 5 and 6 with a mechanical locking or valve control system according to FIGS. 3*a*, 3*b* and 4 at the valve block 10 can be combined with one another for reasons of redundancy.

Once a gas safety valve 12, 14 is to be removed from the valve block 10, it must first be ensured that the relevant gas-conveying connection has been disconnected or shut off by the gas safety valve 12, 14 using the valve ports 36, 38 and the respective assigned ball valve 50, 52 or 58 and the pressure port 26 of the pressure accumulator 42. This is achieved by actuating the assigned hand lever 16, 18 and an assigned mechanical locking of the control disks 30*a*, 30*b* formed at the hand levers 16, 18 or via an appropriate setting of one of the two control positions of the 3-way ball valve 58. In the valve solution using a ball valve 58, an externally actuated control would also be conceivable, for instance. In the form of an electric, hydraulic or pneumatic motor control. Alternatively, or additionally, the blocking of the gas connection from the gas safety valve 12, 14 to the relevant pressure accumulator 42 can be monitored using at least one monitoring device 60, 62. The monitoring devices 60, 62 generate appropriate control and/or monitoring signals for a higher-level control device (not shown). Correspondingly, the active replacement of a gas safety valve 12, 14 by hand can be monitored at the valve block 10, and the valves 50, 52, 58 can be brought into the opening or closing control position as required.

As soon as the fourth connection section 33 is shut off from the pressure accumulator 42 to the gas safety valves 12, 14 using the third ball valve 54, the gas end 45 of the relevant pressure accumulator 42 can be checked and optionally refilled using a filling and testing device 28 (not shown) to be connected to the filling and test port 24. If refilling or adding working gas from the gas supply of the further pressure accumulators 40*a*, 40*b* is required, the third ball valve 54 is permanently opened, so that the working gas can flow from the gas supply of the further pressure accumulators 40*a*, 40*b* to the supply port 22 via the third line sections 51, 51*a*, 51*b*, further to the pressure port 26 via the fourth connection section 33 and further to the pressure accumulator 42 via the fourth line section 53, if necessary. The assigned pressure curve can be monitored using the pressure gauge 44 connected to the pressure gauge port 34.

Furthermore, the pressure in the safety system can be monitored electrically using the pressure transducer 28. If the gas supply in the respective further pressure accumulators 40*a*, 40*b* also has to be filled, assuming that the further pressure accumulators 40*a*, 40*b* are also connected to the valve block 10 via the port 22, this happens simultaneously with the gas end 45 of the relevant pressure accumulator 42 for an open ball valve 54 and, if required, for a closed ball valve 54 using the check valve 56. The pertinent filling using the port 24 then continues until the self-adjusting pressure equilibrium between the further pressure accumulators 40*a*, 40*b*, the refilling device at the port 24 and the relevant pressure accumulator 42 causes the non-return valve 56 to increasingly reach its closed position.

Figure 7A:
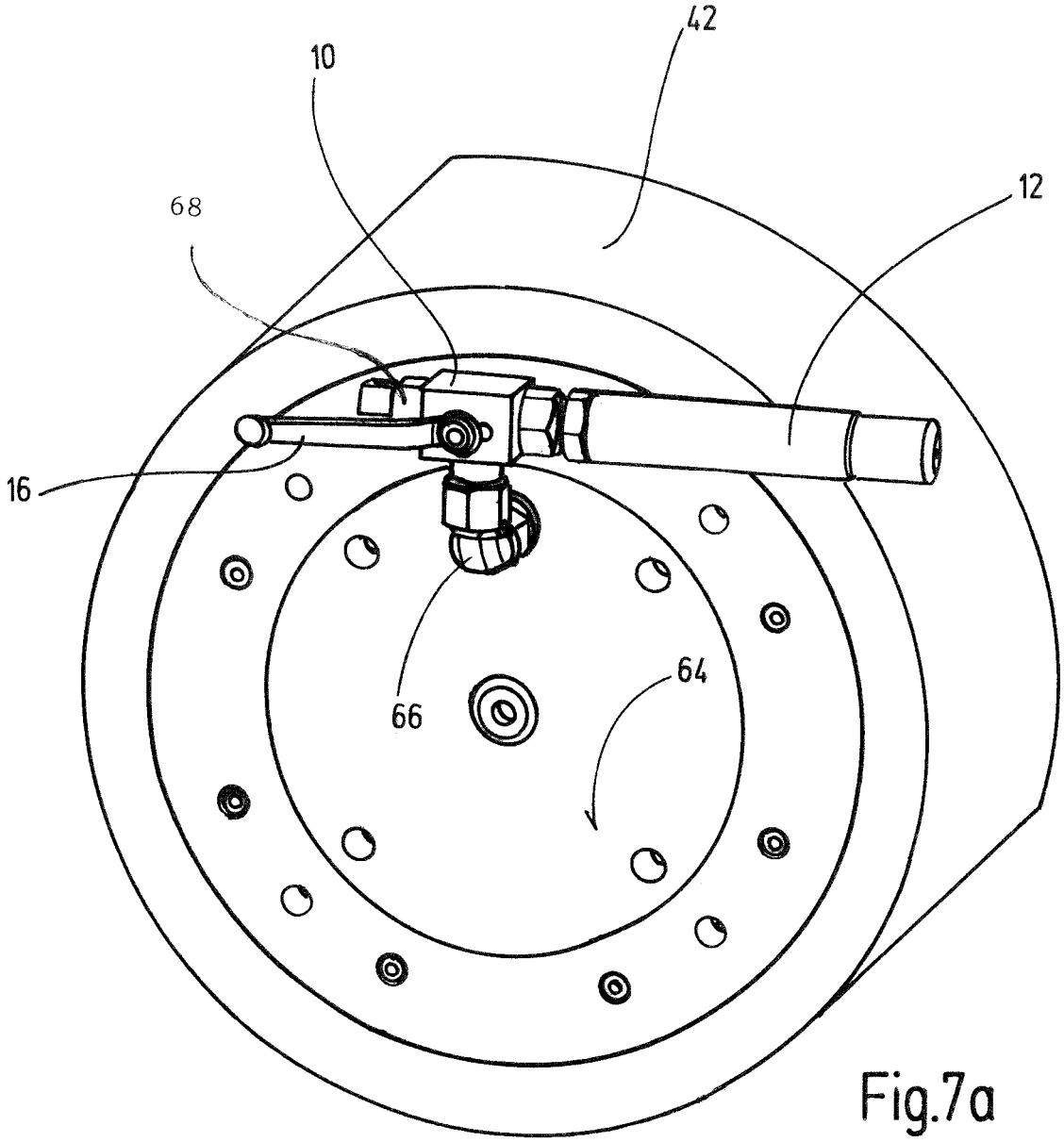
FIGS. 7*a* and 7*b* are perspective views of a further exemplary embodiment of the safety system according to the invention.
Figure 7B:
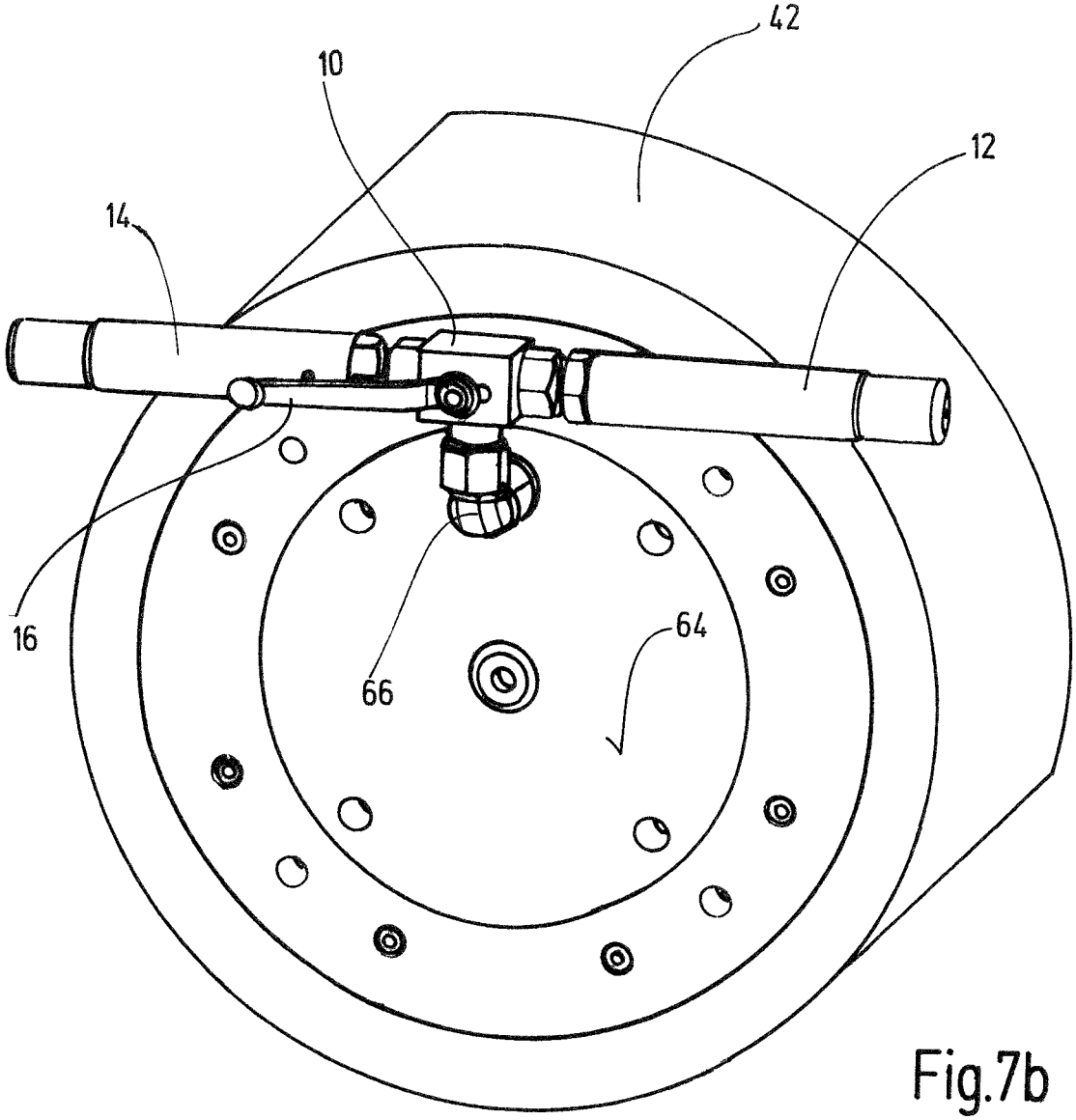

An alternative embodiment of the safety system according to the invention is shown in FIGS. 7*a* and 7*b*. The valve block 10 is designed comparatively small compared to the exemplary embodiment shown in FIGS. 1*a* to 1*c* and encloses a 3-way ball valve, not shown in the perspective view of FIGS. 7*a* and 7*b*. The ball valve can be actuated between its control positions using a hand lever 16 rotatably mounted at the valve block 10. The valve block 10 and the components arranged thereon form a separate structural unit, which is arranged at an end face 64 of a pressure accumulator 42. For this purpose, a right-angled connector 66 is inserted into a passage opening at the end face 64, wherein the valve block 10 is firmly connected to the connecting piece 66.

In the first variant of the safety system shown in FIG. 7*a*, a gas safety valve 12 and a burst disk 68 are arranged at the valve block 10. There, the gas safety valve 12 and the burst disk 68 are aligned horizontally and arranged at opposite sides of the valve block 10. The burst disk 68 has the function that, when the gas safety valve 12 is connected, it is kept free from damage by excessively high-pressure loads due to the rupture of the burst disk 68. The 3-way ball valve arranged in the valve block 10 can be used to block or open a gas-conveying connection between the gas safety valve 12 and the pressure accumulator 42. The 3-way ball valve has an L-shaped or T-shaped drilled hole. The central connection leads to the pressure accumulator 42. The gas safety valve 12 and/or the rupture disk 68 are attached at the respective other ports.

The second variant of the safety system illustrated in FIG. 7*b* differs from the first variant shown in FIG. 7*a* in that, instead of the burst disk 68, a second gas safety valve 14 is arranged at the valve block 10. This results in the advantage that upon removal of one of the two gas safety valves 12, 14 by the other gas safety valve 14, 12 remaining at the valve block 10, a continuous safety function is ensured.

While various embodiments have been chosen to illustrate the invention, it will be understood by those skilled in the art that various changes and modifications can be made therein without departing from the scope of the invention as defined in the claims.

The invention claimed is:

1. A safety system, comprising:

a valve block with first and second valve ports and a first supply pressure port;

first and second gas safety valves connected in fluid communication to the valve block via the first and second valve ports, respectively;

a first pressure accumulator being capable of holding a gaseous pressure medium and being connected in fluid communication to the valve block via the first pressure supply port;

gas-conveying connections extending in the valve block between the first pressure supply port and the first and second valve ports; and a control valve device in the gas-conveying connections selectively and individually opening and blocking fluid flow in the gas-conveying connections between the first pressure supply port and the first and second valve ports such that fluid communication between the first pressure accumulator either one of the first and second gas safety valve is open while fluid communication to the other of the first and second gas safety valves is able to be blocked;

whereby, one of the first and second gas safety valve may be disconnected from the valve block, while the other of the first and second gas safety valves is maintained in fluid communication with the first pressure accumulator.

2. A safety system according to claim 1 wherein the first pressure accumulator comprises a pressure vessel at least one of filled exclusively with the gaseous pressure medium or a hydraulic accumulator with a separator in a storage housing separating a gas side from a liquid side in the storage housing.

3. A safety system according to claim 1 wherein the control valve device includes at least one of a mechanical locking system, a mechanical control system, an electrical monitoring system or a chip-controlled actuation system for controllable valves of the control valve device.

4. A safety system according to claim 1 wherein the valve device comprises first and second ball valves connected in fluid communication between the first gas safety valve and the first pressure accumulator and between the second gas safety valve and the first pressure accumulator, respectively, the first and second control valves having first and second control disks, respectively, mechanically locking the first ball valve in an open position thereof when the second ball valve is moved to a closed position thereof and mechanically locking the second ball valve in an open position thereof when the first ball valve is moved to a closed position thereof.

5. A safety system according to claim 4 wherein the first and second ball valves are manually operable.

6. A safety system according to claim 4 wherein the first and second ball valves have first and second ball valves have first and second hand levers, respectively, moving the first and second ball valves individually between the open and closed positions thereof; and the first and second control disks have first and second cutouts, respectively, on outer peripheries of the first and second control disks, the first and second cutouts enable or block rotational movement of the second and first hand levers, respectively.

7. A safety system according to claim 6 wherein the valve block comprises first and second stop limits interacting with the first and second control disks, respectively, limiting pivoting of the first and second hand levers to 90 degree rotations between the open position in which the respective hand lever is parallel to a longitudinal direction of the respective gas safety valve and the closed position in which the respective hand lever is transverse to the longitudinal direction of the respective gas safety valve.

8. A safety system according to claim 1 wherein the control valve device comprises a mechanical three-way ball valve selectively connecting the first gas safety valve in fluid communication to the first pressure accumulator and blocking fluid communication between the second gas safety valve and the first pressure accumulator in a first control position of the three-way ball valve and connecting the second gas safety valve in fluid communication to the first pressure accumulator and blocking fluid communication between the first gas safety valve and the first pressure accumulator in a second control position of the three-wall ball valve.

9. A safety system according to claim 1 wherein sensors are connected to the control valve device and monitor positions of the control device in opening fluid communication between the first and second gas safety valves and the first pressure accumulator for an electronic monitoring system controlling operation of the control valve device.

10. A safety system according to claim 1 wherein the first pressure accumulator is a hydraulic accumulator supply system; and a control chip of a chip controlled actuation system permits operation of the control valve device controlling fluid communication of the first and second gas safety valves to a hydraulic accumulator supply system of the first pressure accumulator if the hydraulic accumulator supply system is deployed and stops the operation of the control valve device if the hydraulic accumulator supply system is removed with the control valve device blocking fluid communication connections to the first and second gas safety valves.

11. A safety system according to claim 1 wherein the valve block comprises a second pressure supply port connected in fluid gas communication by a connecting line in the valve block to the first pressure supply port via a check valve when the check valve is open; and a second pressure accumulator is connected in fluid communication to the second pressure supply port.

12. A safety system according to claim 11 wherein the first pressure accumulator is a hydraulic accumulator with a gas side connected in fluid communication to the first pressure supply port.

13. A safety system according to claim 11 wherein the second pressure accumulator is a gas pressure accumulator.

14. A safety system according to claim 11 wherein the valve block comprises a filling and testing port with a filling and testing device connected in fluid communication to the filling and testing port, the filling and testing port being directly connected in fluid gas communication to the first pressure supply port; and the filling and testing port is connected in fluid communication between the first and second pressure supply ports via a check valve opening in a direction of the control valve device.

15. A safety system, comprising:

a valve block with first and second valve ports and a pressure supply port;

first and second gas safety valves connected in fluid communication connected to the valve block via the first and second valve ports, respectively;

a first pressure accumulator holding a gaseous pressure medium and being connected in fluid communication to the valve block via the pressure supply port;

gas-conveying lines in the valve block connecting the pressure supply port and the first and second valve ports;

independently operable first and second control valves connected in the gas-conveying lines between the pressure supply port and the first and second valve ports, respectively, such that fluid communication between the pressure supply port and one of the first and second valve ports is open while fluid communication to the other of the first and second valve ports is blocked; and first and second control disks on the first and second control valves, respectively, mechanically locking the first control valve in an open position thereof when the second control valve is rotated to a closed position thereof and mechanically locking the second control valve in an open position thereof when the first control valve is rotated to a closed position thereof.

16. A safety system according to claim 15 wherein the first and second control valves are manually operable.

17. A safety system according to claim 15 wherein the first and second control valves have first and second levers, respectively, rotating the first and second control valves individually between the open and closed positions thereof;

the first and second control disks have first and second cutouts, respectively, on outer peripheries of the first and second control disks, the first and second cutouts enable or block rotation of the first and second hand levers, respectively.

18. A safety system according to claim 16 wherein the valve block comprises first and second stop limits interacting with the first and second control disks, respectively, limiting pivoting of the first and second hand levers to 90 degree rotations between the open position in which the respective hand lever is parallel to a longitudinal direction of the respective gas safety valve and the closed position in which the respective hand lever is transverse to the longitudinal direction of the respective gas safety valve.

19. A safety system, comprising:

a valve block with first and second valve ports and a pressure supply port;

first and second gas safety valves connected in fluid communication connected to the valve block via the first and second valve ports, respectively;

a first pressure accumulator holding a gaseous pressure medium and being connected in fluid communication to the valve block via the pressure supply port;

gas-conveying lines in the valve block connecting the pressure supply port and the first and second valve ports;

independently operable first and second control valves connected in the gas-conveying lines between the pressure supply port and the first and second valve ports, respectively, such that fluid communication between the pressure supply port and one of the first and second valve ports is open while fluid communication to the other of the first and second valve ports is blocked;

first and second hand levers on the first and second control valves, respectively, rotating the first and second control valves individually between respect open and closed positions thereof;

first and second control disks on the first and second control valves, respectively; and first and second stop limits on the valve block interacting with the first and second control disk, respectively, limiting rotation of the first and second hand levers to 90 degree rotations between the open positions in which the respective hand lever is parallel to a longitudinal direction of the respective gas safety valve and the closed positions in which the respective hand lever is transverse to the longitudinal direction of the respective gas safety valve.

20. A safety system, comprising:

a valve block with first and second valve ports and a pressure supply port;

first and second gas safety valves connected in fluid communication connected to the valve block via the first and second valve ports, respectively;

a first pressure accumulator holding a gaseous pressure medium and being connected in fluid communication to the valve block via the pressure supply port;

gas-conveying lines in the valve block connecting the pressure supply port and the first and second valve ports; and a mechanical three position control valve connected in the gas-conveying lines between the pressure supply port and the first and second valve ports selectively connecting in fluid communication the first and second valve ports to the pressure supply port in a first position of the control valve, connecting the first valve port to the pressure supply port and blocking fluid communication of the second valve port and the pressure supply port in a second position of the control valve, and connecting the second valve port to the pressure supply port in fluid communication and blocking fluid communication between the first valve port and the pressure supply port in a third position of the control valve.

21. A safety system, comprising:

a valve block with first and second valve ports and a first supply pressure port;

first and second safety valves connected in fluid communication to the valve block via the first and second valve parts, respectively;

gas-conveying lines in the valve block connecting the first pressure supply port to the first and second pressure ports;

a control valve device in the gas-conveying lines selectively and independently opening and blocking flow between the pressure supply port and the first and second valve ports such that fluid communication between the pressure supply port and at least one of the first and second valve ports is open while fluid communication to the other of the first and second valve ports is able to be blocked; and a control chip of a chip controlled actuation system permits operation of the control valve device controlling fluid communication of the first and second valve ports to the pressure supply port if a hydraulic accumulator is deployed at the pressure supply port and stops operation of the control valve device if the hydraulic accumulator supply system is removed from the pressure supply port with the control valve device blocking fluid communication connections between the first and second valve ports and the pressure supply port.

* * * * *